US005589848A

United States Patent [19]

Shimizu

[11] Patent Number: 5,589,848

[45] Date of Patent: Dec. 31, 1996

[54] ELECTRONIC EQUIPMENT HAVING A DISPLAY DEVICE

[75] Inventor: Hirokimi Shimizu, Yokohama, Japan

[73] Assignee: Canon Kabushiki Kaisha, Tokyo, Japan

[21] Appl. No.: 427,715

[22] Filed: Apr. 21, 1995

Related U.S. Application Data

[63] Continuation of Ser. No. 241,679, May 12, 1994, abandoned, which is a continuation of Ser. No. 826,688, Jan. 28, 1992, abandoned, which is a continuation of Ser. No. 430,975, Nov. 1, 1989, abandoned, which is a continuation of Ser. No. 81,453, Aug. 4, 1987, abandoned.

[30] Foreign Application Priority Data

Aug. 7, 1986 [JP] Japan ..... 61-184170

[51] Int. Cl.[6] ..... G09G 3/36

[52] U.S. Cl. ..... 345/102; 345/87; 364/707

[58] Field of Search ..... 345/87, 102; 59/48, 59/50; 364/707, 709.01, 709.06, 709.08, 709.15; 341/22, 23, 26, 27

[56] References Cited

U.S. PATENT DOCUMENTS

| | | | |
|---|---|---|---|
| 3,869,195 | 3/1975 | Aldrich et al. | 350/345 |
| 4,095,408 | 6/1978 | Kashio | 368/225 |
| 4,202,038 | 5/1980 | Petersson | 341/23 |
| 4,208,869 | 6/1980 | Hanaoka | 350/345 |
| 4,262,350 | 4/1981 | Nagashima | 368/227 |
| 4,285,043 | 8/1981 | Hashimoto et al. | 364/707 |
| 4,367,923 | 1/1983 | Ishikawa | 350/345 |
| 4,502,790 | 3/1985 | Yokoyama | 368/200 |
| 4,562,478 | 12/1985 | Hirasawa et al. | 340/784 |
| 4,665,536 | 5/1987 | Kim | 364/707 |
| 4,834,503 | 5/1989 | Tsujimoto et al. | 340/784 |

FOREIGN PATENT DOCUMENTS

| | | | |
|---|---|---|---|
| 0020796 | 2/1977 | Japan | 340/784 |

*Primary Examiner*—Kee M. Tung
*Assistant Examiner*—Matthew Luu
*Attorney, Agent, or Firm*—Fitzpatrick, Cella, Harper & Scinto

[57] ABSTRACT

An electronic equipment comprises a keyboard for entering data, a processor for processing the data entered by the keyboard, a display device for displaying processing result of the processor, an illumination lamp for illuminating a display screen, and a control circuit for turning off the illumination a predetermined time after the display of the processing result on the display device.

8 Claims, 7 Drawing Sheets

ELECTRONIC EQUIPMENT HAVING A DISPLAY DEVICE

This application is a continuation of application Ser. No. 08/241,679 filed May 12, 1994, abandoned, which is a continuation of application Ser. No. 07/826,688 filed Jan. 28, 1992, abandoned, which is a continuation of application Ser. No. 07/430,975 filed Nov. 1, 1989, abandoned, which is a continuation of application Ser. No. 07/081,453 filed Aug. 4, 1987, abandoned.

BACKGROUND OF THE INVENTION

1. Field of the Invention

The present invention relates to an electronic equipment having a display device with a back light.

2. Related Background Art

In an electronic equipment having a liquid crystal display device, a back light device (illumination lamp) is used to illuminate the opposite side of a display plane of the liquid crystal display device in order to allow observation of the liquid crystal display in a dark place. In such a device, a switch to turn on and off the illumination lamp is provided so that a user may illuminate the liquid crystal display as required.

In such an electronic equipment, if the illumination lamp is turned on for use in the dark place, the illumination lamp is turned on even if no image is displayed on the display and a battery is rapidly consumed when it is used as an illumination power supply.

SUMMARY OF THE INVENTION

It is an object of the present invention to provide an electronic equipment having a reduced power consumption by a back light.

It is another object of the present invention to provide an electronic equipment which can automatically turn off the back light.

It is still another object of the present invention to provide an electronic equipment which can set any time from display of an image on a display device to turn-off of the back light.

It is a further object of the present invention to provide an electronic equipment having no back light on/off switch.

DETAILED DESCRIPTION OF THE PREFERRED EMBODIMENTS

Figure 1:
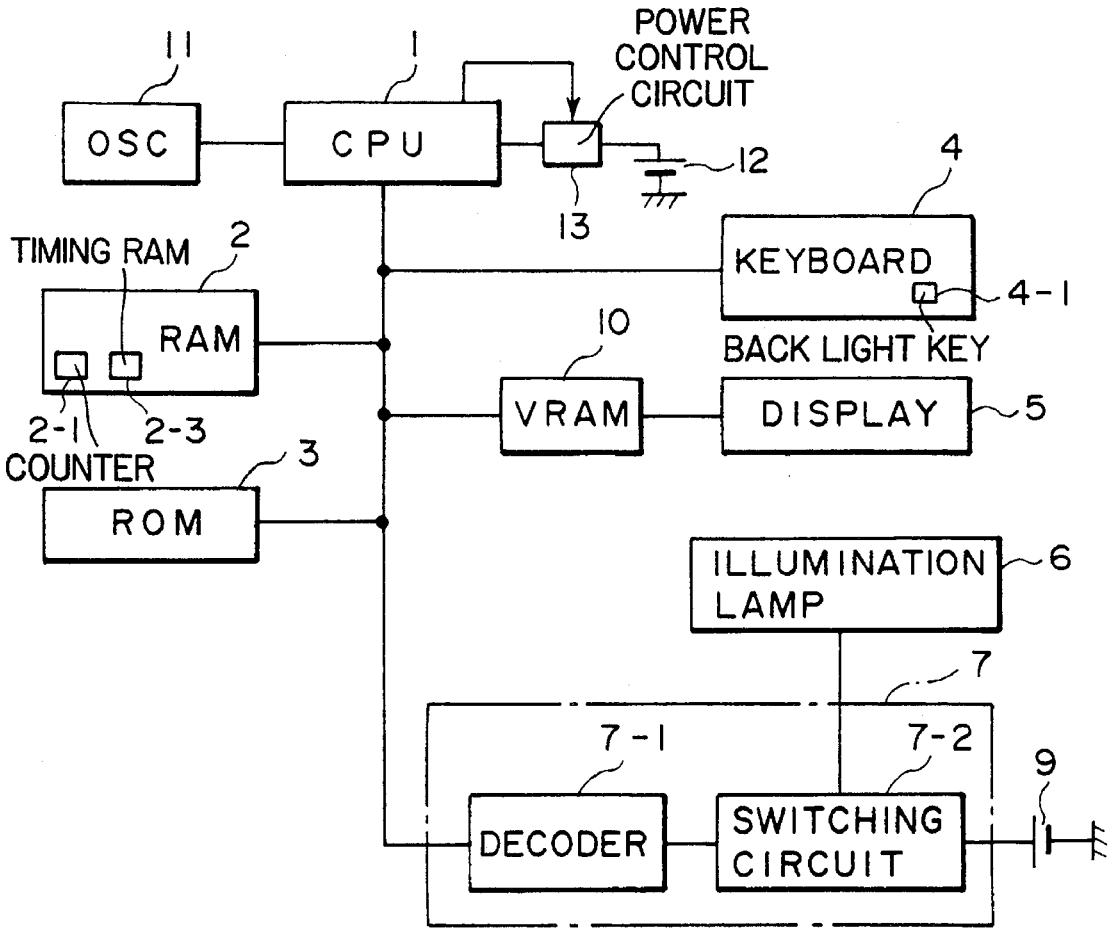
FIG. 1 shows a block diagram of the present invention.

FIG. 1 shows one embodiment of the present invention. Numeral 1 denotes a processor which executes a control process shown in FIG. 3. Numeral 2 denotes a random access memory (RAM) which stores variables used in the control process, numeral 3 denotes a read-only memory (ROM) which stores the control process shown in FIG. 3, and numeral 4 denotes a keyboard which enters processing information. It has a key 4-1 for indicating turn-on and turn-off of an illumination lamp 6. Input information and process result of the CPU 1 are displayed on a liquid crystal display 5. The display 5 has the illumination lamp 6 to illuminate a display screen. The illumination lamp 6 is turned on and off by a switching device 7 in accordance with a control signal from the CPU 1, which controls the turn-on and turn-off of the illumination lamp 6. Numeral 7-1 denotes a decoder which receives the 4-bit control signal from the CPU 1 which indicates the turn-on or turn-off of the illumination lamp, when the control signal is "ON", the decoder 7-1 holds a pulse "H", and when the control signal is "OFF", it holds a pulse "L".

Numeral 7-2 denotes a switching circuit for turning on or off the illumination lamp 6 in accordance with the output pulse signal from the decoder 7-1. Numeral 9 denotes a power supply for the illumination lamp 6.

Figure 4:
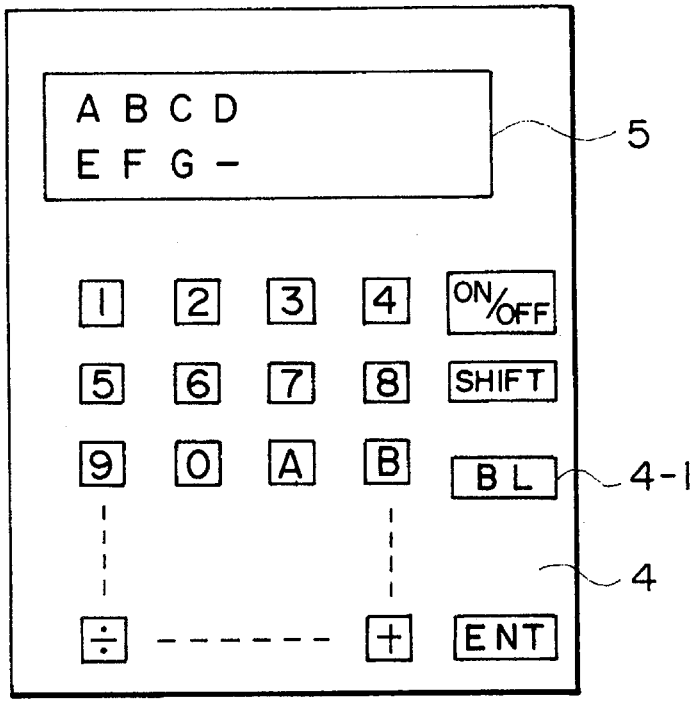
FIG. 4 shows an outer view of an electronic equipment of the present invention.

An outer view of the electronic equipment is shown in FIG. 4. Numeral 4 denotes a keyboard, and numeral 4-1 denotes a back light key for turning on and off the back light. Each time it is depressed, the state is flipped. Namely, if the back light key 4-1 is depressed when the back light 6 is on, the back light is turned off, and if the back light key 4-1 is depressed when the back light is off, the back light 6 is turned on. Numeral 5 denotes a display.

Figure 2:
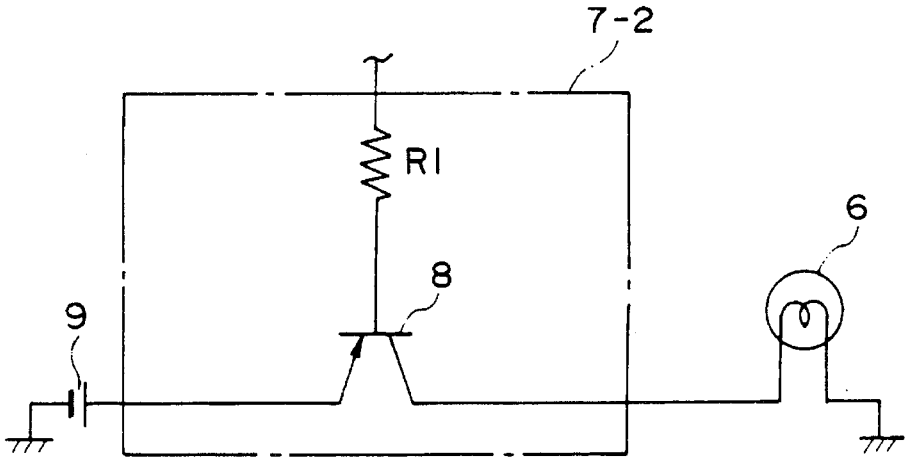
FIG. 2 shows a lamp switching device.

FIG. 2 shows the switching circuit 7-2 of the present embodiment. Resistor R1 is used to limit a base current to a desired value to protect transistor 8 from damage. When the signal "H" to turn on the illumination lamp 6 is applied to a base of the transistor 8 from the decoder 7-1, a current flows from the power supply 9 to the illumination lamp 6 so that the illumination lamp 6 is turned on. When the signal "L" to turn off the illumination lamp 6 is applied to the base of the transistor 8 from the decoder 7-1, no current flows from the power supply to the illumination lamp 6 and the illumination lamp 6 is kept turned off.

In FIG. 1, numeral 10 denotes a VRAM which develops data to be displayed on the display 5. Numeral 12 denotes a power supply battery to supply a power to the electronic equipment. Numeral 13 denotes a power on/off control circuit which turns on and off the power under the control of the CPU 1.

While the transistor switching circuit 7-2 is used in the present embodiment, the switching circuit may use relay or switching semiconductor.

Figure 3:
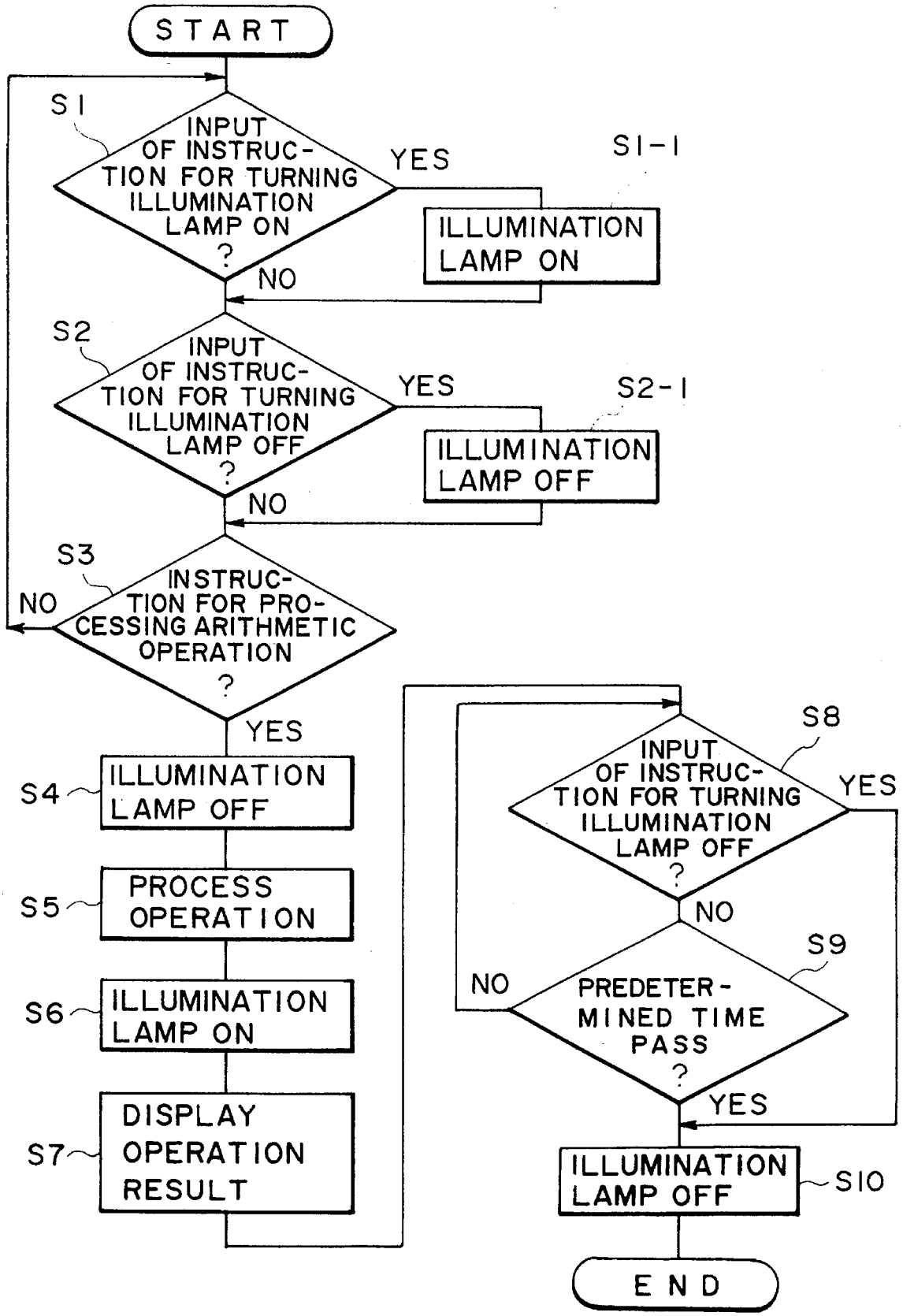
FIG. 3 shows a flow chart of a control process in an embodiment of the present invention.

FIG. 3 shows an example of the control by the CPU 1 in the present embodiment.

In a step S1, the CPU 1 checks whether the turn-on of the illumination lamp 6 has been indicated or not. If the user has indicated the turn-on of the illumination lamp 6 by the switch 4-1 on the keyboard 4, the CPU 1 sends a control signal to turn on the illumination lamp 6 to the switching device 7 in a step S1-1. When the switching device 7 receives the "ON" signal from the CPU 1, it supplies the current from the power supply 9 to the illumination lamp 6 to turn on the illumination lamp 6.

If the indication to turn on the illumination lamp 6 has not been issued, the process proceeds to a step S2. In the step S2, whether the user has issued an indication to turn off the illumination lamp 6 or not is checked. If it has not been issued, the process proceeds to a step S3. If it has been issued, the process proceeds to a step S2-1 where the CPU 1 sends a control signal to the switching device 7 to turn off the illumination lamp 6.

In a step S3, whether processing such as execution of an application program has been requested by the operator or not is checked, and if it has not been requested, the process returns to the step S1 where it waits for the processing request. If it has been requested, the CPU 1 sends the "OFF" signal to the switching device 7 in a step S4 to turn off the illumination lamp 6.

In a step S5, the CPU 1 executes the request processing, and after processing, the CPU 1 turns on the illumination lamp 6 and displays the processing result (steps S6–S7).

In a step S8, whether the indication to turn off the illumination lamp 6 has been issued or not is checked, and if it has been issued, the illumination lamp is turned off in a step S10. This ends the control process.

If the indication to turn off has not been issued, the CPU 1 counts a time from the turn-on of the illumination lamp or the extinguishment of the display output by an internal counter 2-1, and after a predetermined time (step S9), the CPU 1 turns off the illumination lamp 6 in the step S10. The predetermined time may be measured by counting reference clocks by the counter 2-1.

In accordance with the present invention, the illumination lamp 6 is kept turned on or off before the processing is carried out, and the illumination lamp 6 is turned off during the execution of processing. When the processing result is displayed, the illumination lamp 6 is turned off if the turn-off indication is issued or when the predetermined time has elapsed since the display output has been extinguished. Accordingly, the power consumption of the battery 9 can be reduced.

In the present embodiment, the illumination lamp 6 is turned off each time the CPU 1 carries out the processing. In other electronic equipment having the liquid crystal display device, the illumination means may be turned on in accordance with the display output to the liquid crystal display device.

In the present embodiment, the illumination lamp 6 is turned on and off by the operator by the turn-on key 4-1 on the keyboard 4. The turn-on key 4-1 need not be limited to one key but control keys such as "X" and "÷" keys and keys which are not used in the execution of the program may be used so that the illumination lamp is alternately turned on and off when one of those keys is depressed.

The turn-on and turn-off of the illumination lamp may also be controlled by depressing a shift key for a predetermined time.

Figure 6:
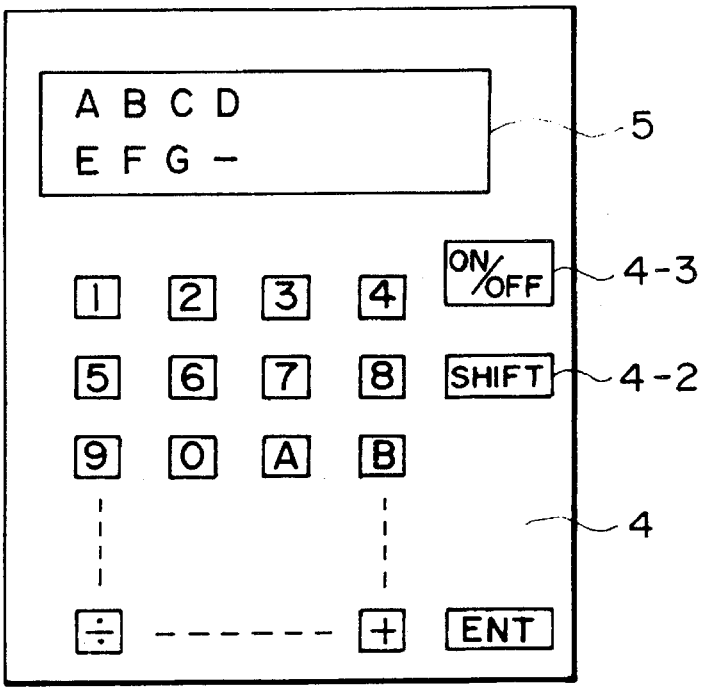
FIG. 6 shows an outer view of the other embodiment of the present invention.
Figure 5:
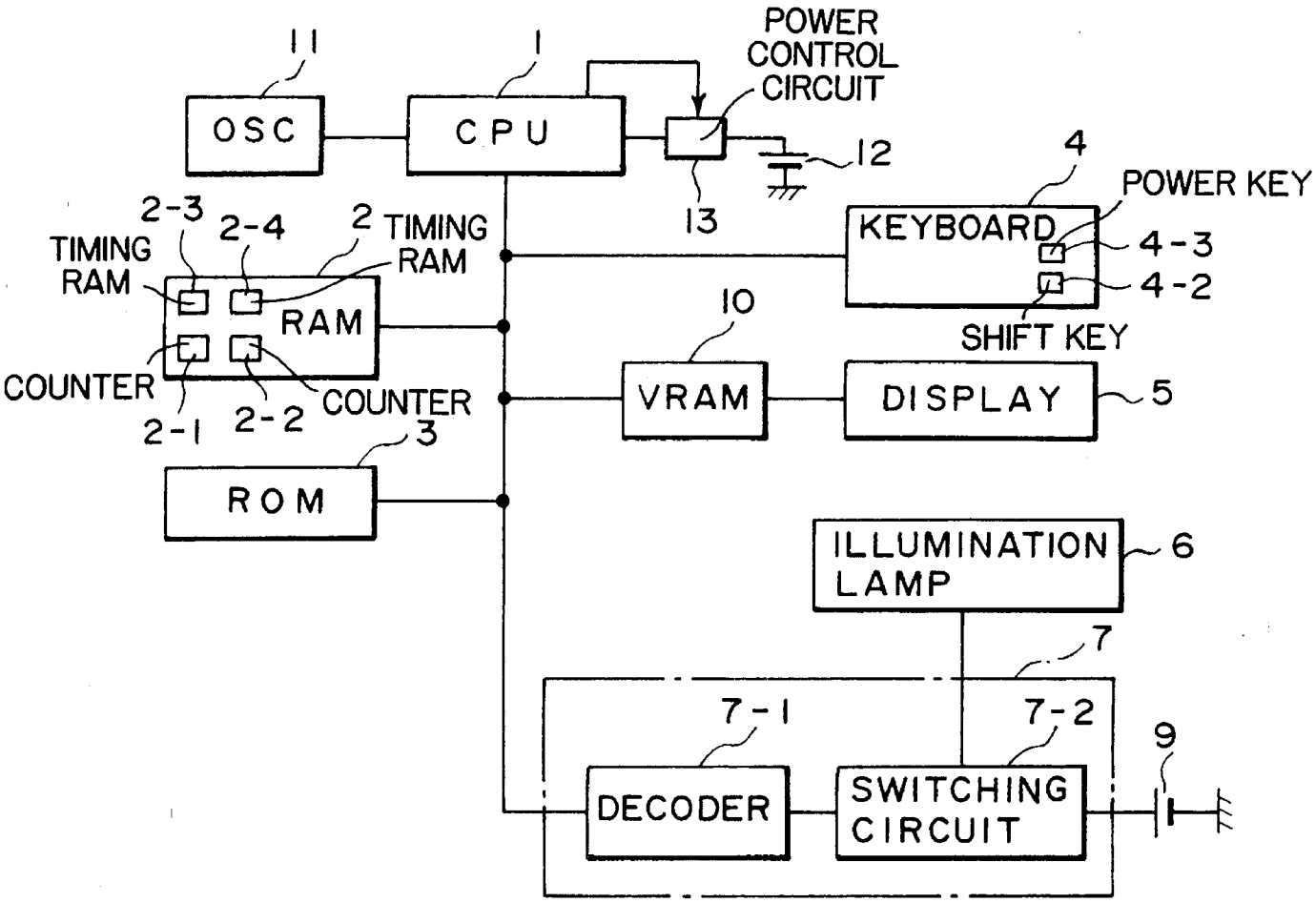
FIG. 5 shows another embodiment of the present invention.

Another embodiment of the present invention is now explained. FIG. 6 shows an outer view of an electronic equipment with a display device in accordance with the present embodiment of the present invention. It is substantially identical to the embodiment of FIG. 1 but it does not have the turn-on key 4-1 as shown in FIG. 5. Numeral 12 denotes a power supply to supply a power to the electronic equipment, and numeral 13 denotes a switch which is controlled by the CPU 1.

Numeral 5 denotes a display device, numeral 4 denotes a keyboard, numeral 4-2 denotes a shift key for shifting a character data entered by keying the keyboard to select a upper case character or a lower case character, and numeral 4-3 denotes a power on/off key to turn on or off the power supply . The state of the power key 4-3 and the shift key 4-2 flip each time they are depressed. For example, if the power key 4-3 is depressed when it is in the ON state, it turns off the power supply, and if the shift key 4-2 is depressed in the upper case state, it selects the lower case character.

Figure 7:
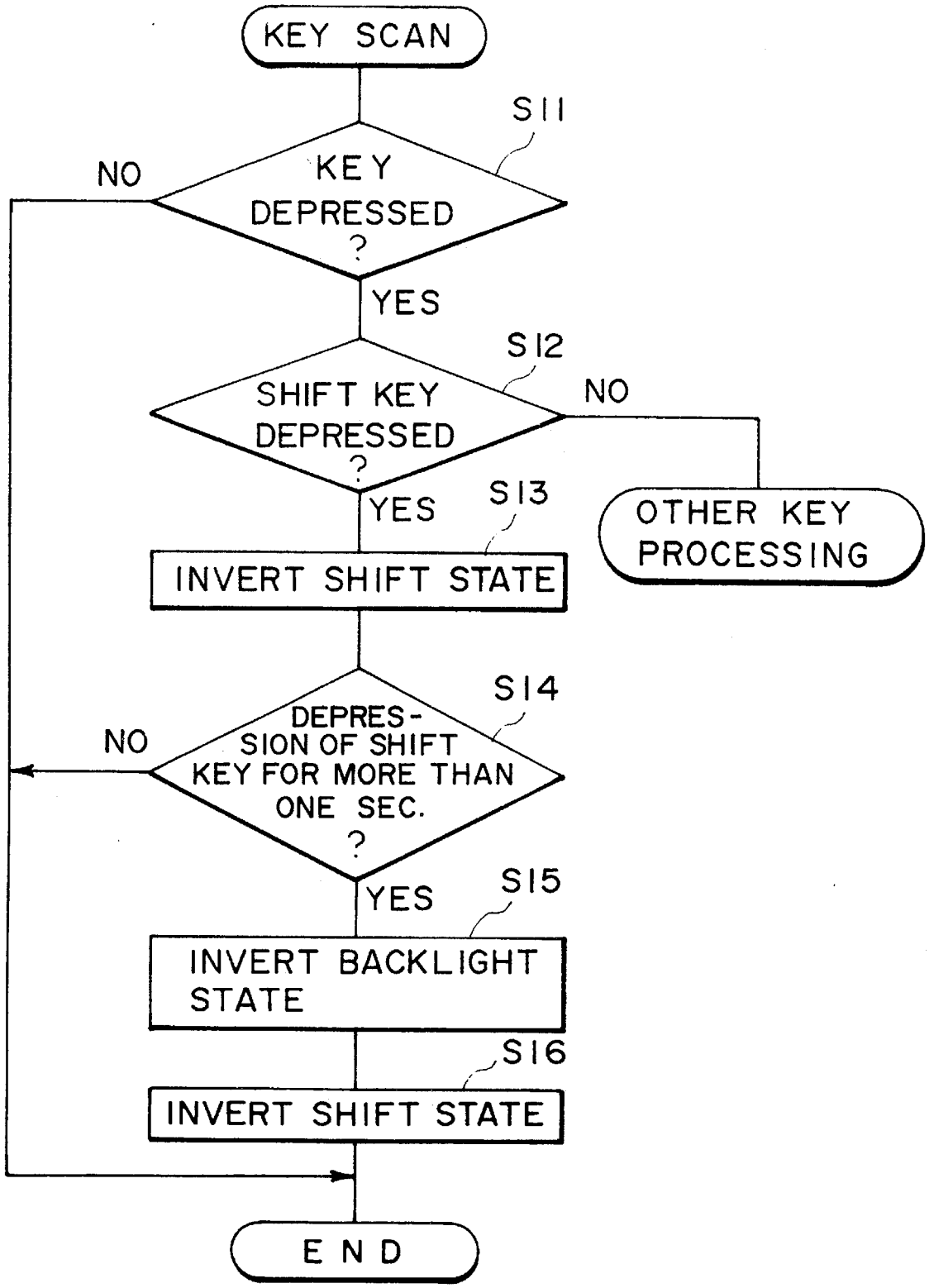
FIGS. 7, 8 and 9 show flow charts of control processes in the other embodiment of the present invention.

FIG. 7 shows a flow chart of the key scan. In a step S11, whether any key has been depressed or not is checked, and if it has been depressed, whether the depressed key 4-2 is the shift key 4-2 or not is checked in a step S12. If it is not the shift key 4-2, the processing for the depressed key is executed. If it is the shift key 4-2, the shift state is reversed, that is, the upper case state is changed to the lower case state and vice versa in a step S13.

In a step S14, whether the shift key 4-2 was depressed for more than one second or not is checked. If it is for more than one second, the back light state is inverted, namely, the turn-on state is changed to the turn-off state and vice versa. In a step S16, the shift state is reversed. In the step S16, the shift state is returned to the state prior to the depression of the shift key 4-2.

In this manner, the turn-on and turn-off of the back light 6 are switched by the shift key 4-2.

Figure 8:
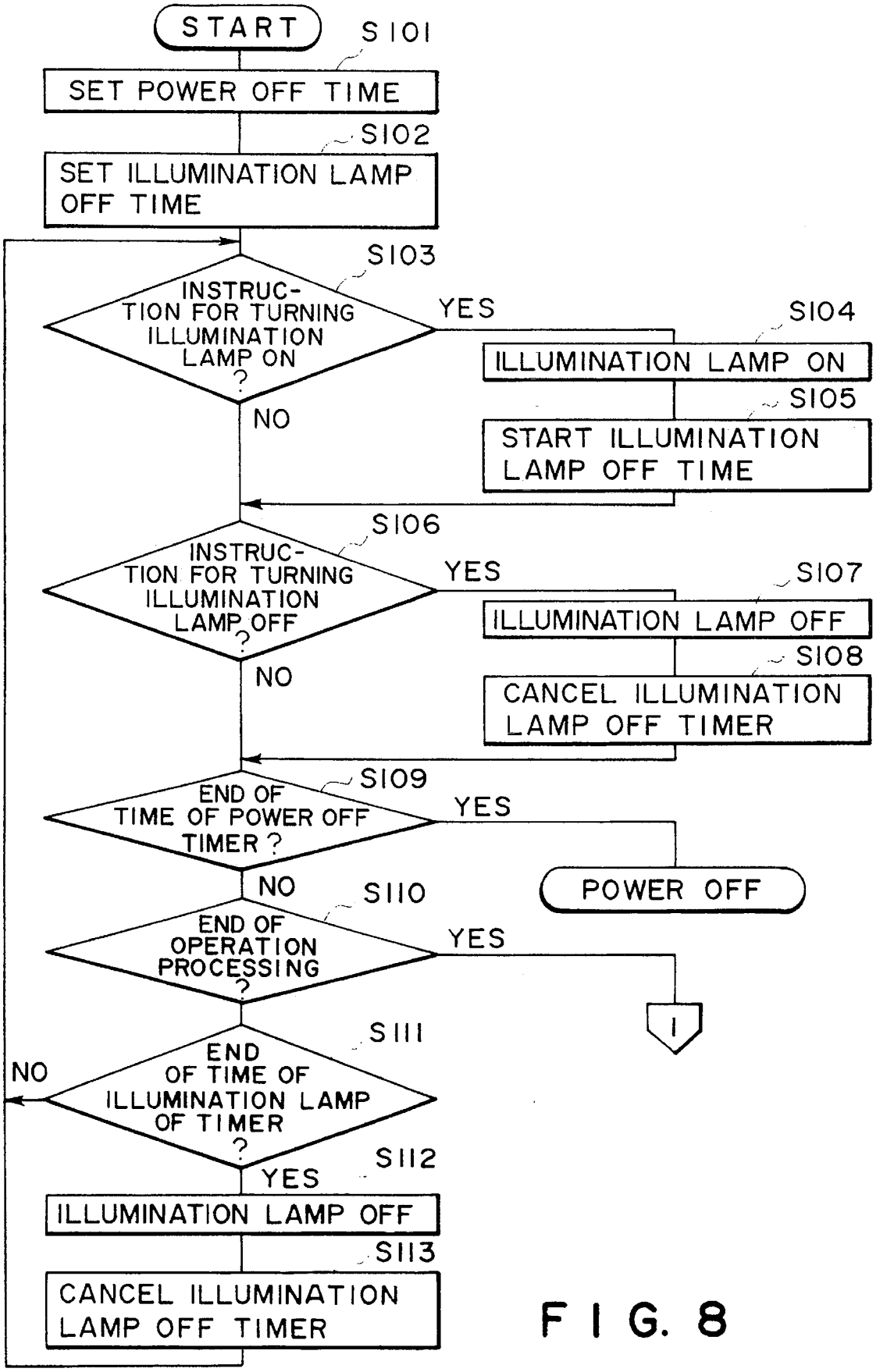

The control process of the back light 6 is now explained with reference to the flow charts of FIGS. 8 and 9.

In a step S101, a turn-off time of the power supply is set so that the power supply is automatically turned off a predetermined time after the last manipulation of a key of the electronic equipment. It is set by a ten-key on the keyboard. The turn-off time thus set is stored in a RAM area 2-3 and also set in a counter 2-2 which decrements its content of a pulse supplied from an oscillator 11.

In a step S102, a turn-off time of the back light 6 is set so that the back light 6 is automatically turned off a predetermined time after the last manipulation of the key of the electronic equipment. It is set by the ten-key of the keyboard 4. The turn-off time thus set is stored in a RAM area 2-4 and also set in a counter 2-1 which decrements its content by a pulse from the oscillator 11.

In a step S103, whether the turn-on of the back light 6 has been requested or not is checked, that is, whether the request of turn-on has been issued or not in the step S15 of FIG. 7, is checked and if it has not been issued, the process proceeds to a step S106. If it has been issued, the process proceeds to a step S104 where information to turn on the back light 6 is sent to a decoder 7-1 so that the back light 6 is turned on. In a step S105, an illumination off-timer is started, that is, the data in the RAM area 2-2 is transferred to the counter 2-1 which is decremented in synchronism with the pulse from the oscillator 11. Then, the process proceeds to the step S106.

In the step S106, whether the turn-off of the back light 6 has been requested or not is checked, that is, whether the request to turn-off has been issued or not in the step S15 of FIG. 7 is checked. If it has not been issued, the process proceeds to a step S109, and if it has been issued, the back light 6 is turned off through the decoder 7-1. In a step S108, the illumination off-timer is cancelled, that is, the counting of the counter 2-1 is stopped and the counter is reset. Then the process proceeds to a step S109.

In the step S109, whether the power off-timer has been timed out or not is checked, that is, whether the count of the counter 2-2 is "0" or not is checked. If it is "0", the power supply is turned off, and if it is not "0", the process proceeds to a step S110. In the step S110, whether the processing is being carried out or not is checked, and if it is, the process shifts to the flow chart of FIG. 9, and if it is not, the process proceeds to a step S111 where whether the illumination off-timer has been timed out or not is checked, that is, whether the count of the counter 2-1 is "0" or not. If it is not "0", the process returns to the step S103, and if it is "0", the process proceeds to a step S112 where the back light 6 is turned off in the same manner as the step S107, and in a step S113, the illumination off-timer is cancelled, that is, the setting is again set into the counter 2-1. Then the process returns to the step S103.

Figure 9:
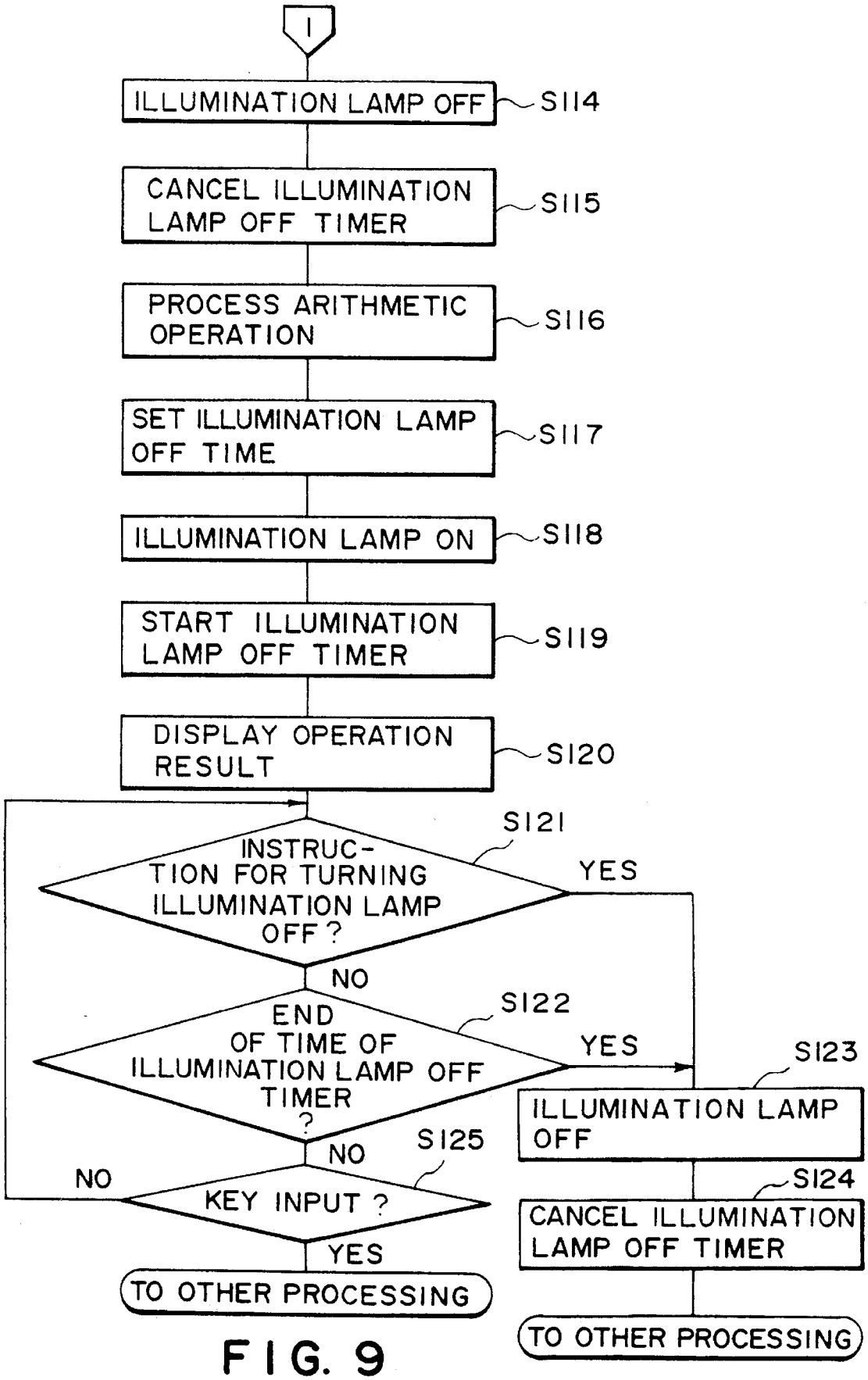

In the step S110, if the processing is being carried out, the process is controlled by the flow chart of FIG. 9.

In a step S114, the back light 6 is turned off in the same manner as the step S107. In a step S115, the illumination off-timer is cancelled in the same manner as the step S108. In a step S116, the processing is carried out. In a step S117, the illumination off-time is set, that is, the data in the RAM area 2-4 is set into the counter 2-1. In a step S118, the back light 6 is turned on in the same manner as the step S104. In a step S119, the illumination off-timer is started in the same manner as the step S105. In a step S120, the display data is developed into the VRAM 10 to display the processing result.

In a step S121, whether the request to turn off the illumination has been issued or not is checked, and in a step S122, whether the illumination off-timer has been timed out or not is checked in the same manner as the steps S106 and S111, respectively. In the back light 6 is to be turned off, the process proceeds to steps S123 and S124 where the same process as that in the steps S107 and S108 are carried out. In the step S122, if the illumination off-timer has not been timed out, the process proceeds to a step S125 where whether the key has been manipulated or not is checked, and if it has been, other process is started, and if it has not been, the process returns to the step S121.

In accordance with the present invention, the illumination lamp is automatically turned off except when the illumination of the display device is required, and the power consumption of the illumination power supply can be reduced. Further, in case of error such as input error or program error, a message is displayed on the display device and the illumination lamp is blinked to call attention of the operator.

Since the back light off-time and the power off-time can be freely set, they may be appropriately selected from the standpoints of power saving and operability.

Since the turn-on and turn-off of the back light is controlled by the shift key, the number of keys on the keyboard is reduced and the operability is improved.

I claim:

1. Electronic equipment comprising:

a keyboard for entering a plurality of kinds of data by a same key, comprising a selecting key for selecting one of said plurality of kinds of data to be entered by the same key;

display means for displaying data, said display means having a display screen;

illumination means for illuminating said display screen of said display means, having a first illumination state and a second illumination state;

a power supply included within said electronic equipment for supplying power to said electronic equipment;

first manual time setting means for setting an illumination time of said illumination means;

second manual time setting means for setting a power supply time of said power supply for said electronic equipment;

control means for changing an illumination state of said illumination means after completion of the illumination time set by said first manual time setting means to reduce power consumption by said illumination means; and power supply control means for causing said power supply to stop the power after completion of the power supply time set by said second manual time setting means.

2. An electronic equipment according to claim 1 wherein said display means comprises a liquid crystal display.

3. An electronic equipment according to claim 1 further comprising indication means disposed on said keyboard for indicating the illumination state of said illumination means independently of said control means.

4. Electronic equipment comprising:

input means for entering information;

processing means for processing said information entered by said input means;

display means for displaying said information processed by said processing means;

back light means for said display means;

time memory means for storing desired time information entered by said input means;

checking means for checking on elapse of time of said desired time information;

control means for controlling said back light means to stop lighting of said back light means for said display means when said time of said desired time information has elapsed through said checking means to reduce power consumption by said back light means;

a power supply included within said electronic equipment for supplying power to said electronic equipment;

manual time setting means for setting a power supply time of said power supply for said electronic equipment; and power supply control means for causing said power supply to stop the power after completion of the power supply time set by said manual time setting means.

5. An electronic equipment according to claim 4 wherein said display means comprises a liquid crystal display.

6. An electronic equipment according to claim 4 wherein said input means comprises a keyboard.

7. An electronic equipment according to claim 4 wherein said checking means comprises a counter for measuring elapse of time.

8. Electronic equipment comprising:

a keyboard for entering a plurality of kinds of data by a same key, having a shift key for selecting one of said kinds of data to be entered by the same key;

display means, including a display screen, for displaying data;

illumination means for illuminating said display screen of said display means, having a first illumination state and a second illumination state; and control means, responsive to actuation of said shift key of said keyboard, for determining whether said shift key has been depressed for a first predetermined period of time, and when said shift key has been determined to be so depressed, for changing a selection of said kinds of data to be entered by the same key and for detecting whether said shift key has been continuously depressed for a second predetermined period of time that is longer than the first predetermined period of time, and when said shift key has been detected to be so continuously depressed, for changing said first illumination state into said second illumination state.

* * * * *